US005167733A

United States Patent [19]

Hsieh

[11] Patent Number: 5,167,733

[45] Date of Patent: Dec. 1, 1992

[54] METHOD FOR MANUFACTURING IRON-MANGANESE-ALUMINUM ALLOY CASTINGS

[75] Inventor: Chang-Sheng Hsieh, Kaohsiung, Taiwan

[73] Assignee: Eastern Precision Casting Co., Ltd., Kaohsiung, Taiwan

[21] Appl. No.: 831,957

[22] Filed: Feb. 6, 1992

[51] Int. Cl.[5] ..... C21D 9/00

[52] U.S. Cl. ..... 148/522; 148/526

[58] Field of Search ..... 148/522, 538, 526, 619, 148/637, 329; 420/72, 77; 164/477, 485; 273/167 R

[56] References Cited

U.S. PATENT DOCUMENTS 3,201,230 8/1965 Mitchell et al. ..... 148/619

4,398,965 8/1983 Campau ..... 148/522

5,069,871 12/1991 Fuller ..... 420/72

*Primary Examiner*—Deborah Yee

*Attorney, Agent, or Firm*—Shoemaker & Mattare Ltd.

[57] ABSTRACT

An Fe-Mn-Al alloy is useful for making a precision casting having uneven or thin wall thickness. The alloy, which contains carbon 1.5-2.0% manganese 32.36% aluminum 6-8%, molybdenum 1.0-1.5% and iron remainder, is heated to 1400°-1420° C. to melt, an the molten alloy is poured into a ceramic mold which is preheated to 1300°-1320° C.; the ceramic mold having a wall thickness of about 5 mm and an air permeability of about $6.5\times10^{-3}$ $cm^3/sec.cm^2$. aq.

The castings are further welded into a shaped article such as a golf club head, and then heat treated to adjust its toughness and hardness.

2 Claims, 3 Drawing Sheets

METHOD FOR MANUFACTURING IRON-MANGANESE-ALUMINUM ALLOY CASTINGS

BACKGROUND OF THE INVENTION

The present invention relates to a method for manufacturing iron-manganese-aluminum (Fe-Mn-Al) alloy castings, more particularly to the manufacture of precision castings of Fe-Mn-Al alloys with a ceramic mold, for such application as the manufacture of golf club heads.

Conventionally, the head of a golf club is made of wood. In recent years, a new golf club head made of alloy has been developed; such a new golf club head is called a "metal wood."

Most metal woods commercially available are made of alloys whose composition varies from one manufacturer to another. Because of the relatively high degree of precision required in making a metal wood, conventional stainless steel, which has excellent mechanical properties but is relatively costly when used to make a shaped article, is not used.

The Fe-Mn-Al alloys have been newly developed for making a shaped article such as a metal wood. Experiments have found that alloys of this type have a high toughness, a high corrosion-resistance, and a high wear-resistance. However, the method for using such alloys, particularly in making a precision casting such as a metal wood, has not been developed to a commercial level.

Therefore it is an object of the present invention to offer a method for manufacturing iron-manganese-aluminum alloy castings.

It is another object of the present invention to offer a method for manufacturing the head of a golf club driver, which is commonly called a "metal wood."

SUMMARY OF THE INVENTION

The method for manufacturing Fe-Mn-Al casting according to this invention includes the processes of casting an alloy which contains C 1.5–2.0%, Mn 32–36%, Al 6–8%, Mo 1.0–1.5% and Fe 59.5–52.5%, welding the alloy casting, and heat-treating the alloy casting.

The casting process is performed by melting the alloy at a temperature of 1400°–1420° C. and pouring the molten alloy into a ceramic mold maintained at a temperature of 1300°–1320° C. The mold has a wall thickness of about 5 mm and is composed of five layers; the mold has an air permeability of $6.5\times10^{-3}$ $cm^3/sec\ cm^2$ aq.

The welding is performed by a TIG welding process with 40–60 amperes without the need of a welding rod, to join together components that have been separately cast, to constitute a final product such as a golf club head. The heat treatment includes the processes of quenching the alloy casting after welding which has been heated to 1030°–1050° C. for 1–2 hours and then quenched in water or oil at room temperature, and annealing the alloy casting at 450°–550° C. for 1–2 hours.

DETAILED DESCRIPTION OF THE PREFERRED EMBODIMENT

The method for making an alloy casting, for example, a metal wood golf club, in accordance with the present invention includes three processes, namely, casting, welding and heat treatment. These processes are outlined hereinafter.

1. CASTING:

According to the results of several tests on the effect of the chemical content of Fe-Mn-Al alloys and the structure of a metal wood and the mechanical properties of the alloys themselves, a preferable Fe-Mn-Al alloy consists of carbon 0.5–2.0%, manganese 25–35%, aluminum 5–10%, molybdenum 0.5–1.5%, and iron remainder, the most preferable Fe-Mn-Al alloy consists of carbon 1.5–2%, manganese 32–36%, aluminum 6–8%, molybdenum 1.0–1.5% and iron remainder.

Figure 1:
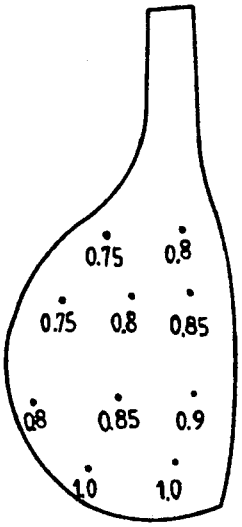
FIG. 1 is a schematic top view of the metal wood casting, showing the distribution of the wall thickness of the upper part of the head body, in millimeters.
Figure 2:
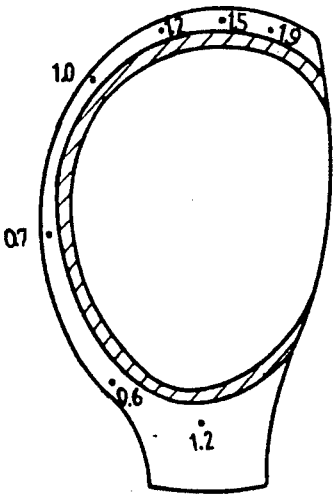
FIG. 2 is a schematic cross-sectional view of the metal wood casting, showing the distribution of the wall thickness of the side part of the head body, in millimeters.
Figure 3:
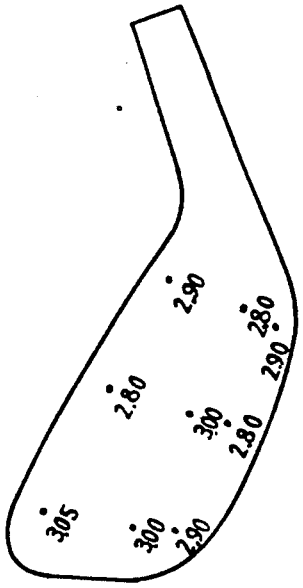
FIG. 3 is a schematic front view of the metal wood casting, showing the distribution of the thickness of the face portion, in millimeters.

Because the Fe-Mn-Al alloy tends to produce a fragile structure of manganese and shrinkage holes in the crystal structure of Fe-Mn-Al alloy during the process of slow cooling, and also because the alloy has a high expansion rate and low heat conductivity, stress may cause a Fe-Mn-Al alloy casting to crack easily after casting. Further, because the Fe-Mn-Al alloy contains a large amount of low melting point components which tend to incur an oxidation loss during the process of melting, this hinders the flow of a molten Fe-Mn-Al alloy and creates the inclusion of slags in the alloy castings. Such phenomenon is generally regarded as an "inclusion". If an Fe-Mn-Al alloy casting is made according to a known method used in the production of a nickel-chrome steel casting, it can not eliminate the problems of misrun, inclusion and brittleness, and the casting will crack during cooling. These misrun and inclusion problems result from the aluminum element which is activated at high temperature. During melting, a layer of slag on the surface of the molten alloy affects its flow, and therefore, inclusion takes place. This problem becomes serious when the melting temperature and time are increased. However, reducing the melting temperature may affect the formation of the shape of a metal wood (whose thickness is generally uneven as shown in FIGS. 1 to 3). The problem of oxidation loss can be eliminated by shortening the melting time, i.e., increasing the melting speed. With respect to the problem of brittleness which results from the high melting temperature and long melting time and improper cooling speed (i.e., the speed of solidification), it can be eliminated by adding fluxes which isolate the molten alloy from the air. So far as the problem of cracking is concerned, it has been found that castings start to crack at 900° C. The problem may sometimes be as minor as a haircrack; however, it may also break the shell-mold, and/or crack and deform the alloy casting. Such cracking problems are caused by the trapping of gas, misruns, and cold shuts in the alloy casting, and also by the stress created during cooling. The inventor tried three methods to solve the aforesaid problems. At first, slow cooling and rapid cooling were attempted in order to avoid cooling stress. After casting, the alloy castings were immediately put in a furnace at 1000° C. for cooling at a cooling speed of 100° C./hour. The alloy castings were removed from the furnace when the temperature was reduced to 500° C. and then dipped in a cooling water or placed on a cooling metal plate for cooling by blowing cold air thereon. According to test results, the slow cooling process provided a yield of 20%, but was dangerous and took much time to perform and, further, a layer of aluminum oxide was formed on the surface of the castings thus obtained. The alloy castings often broke into pieces during the process of water quenching. There was little improvement in the alloy castings which were cooled with cold air. Therefore, the above tested processes are not suitable for mass production.

After failure in various cooling processes, the inventor tried a temperature control. According to the test, it was found that the quality of the alloy casting could be controlled if the relation between the mold temperature and the casting temperature were adequately controlled. If a heat-resisting ceramic mold was used, the mold temperature could be increased while the temperature of molten alloy to be poured could be relatively reduced, and therefore, oxidation loss and problems of misrun and inclusion could be eliminated. A test was so conducted that the mold temperature was increased from 1200° C. at an increment of 20° C. each time while the pouring temperature was reduced from 1520° C. at the rate of 30° C. each time. When the mold temperature exceeded 1320° C., the mold was partly melted and deformed and thus could not be used. When the pouring temperature was reduced to 1360° C. or below, the shape formation of the alloy casting was not satisfactory. When the mold temperature was increased to 1290° C.-1300° C. and the temperature was controlled at 1400° C.-1420° C., a satisfactory shape forming was achieved. A metal wood casting thus made had a stable alloy composition and high toughness, however, fine cracks were found on its toe portion. It is believed that this was caused because the strength of the mold surpassed the shrinkage stress of the alloy casting and the formation of hot spots.

Therefore the present inventor studied the characteristics of the structural strength, the air permeability, the heat distortion and loosening of different ceramic molds to be used in casting Fe-Mn-Al alloys. It was expected to find a ceramic mold having the properties of good air permeability and heat-resistance and the properties of high wet strength against expansion stress during a dewaxing process and dry strength against heat impact during the pouring of molten alloy, and more important, to find a ceramic mold which collapses automatically upon the formation of shrinkage stress during the process of cooling (solidification). At the initial state, a ceramic mold was made according to the formula in preparing a ceramic mold for casting a conventional nickel-chrome stainless steel, the mold having five layers over one another, with the following compositions: (the amount of content is in wt %)

1st layer: zircon sand 325 mesh 55-65%, corroidal silica 35-25%, and zircon sands 100 mesh 10%;

2nd layer: MULCOA powder 200 mesh 60-75%, corroidal silica 40-25%;

3rd layer: MULCOA powder 200 mesh 60-70%, scaly graphite 3-6%, corroidal silica 37-24%;

4th layer: same as the 3rd layer; and

5th layer: zircon sand 325 mesh 65-75%, and corroidal silica 35-25%.

The MULCOA powder contains $Al_2O_3$ 47.8%, $SiO_2$ 49.3%, $TiO_2$ 1.78%, $Fe_2O_3$ 0.98%, CaO 0.03%, MgO 0.04%, $Na_2O$ 0.04%, $K_2O$ 0.03%.

The Zircon sand contains $ZrO_2$ 65.0%, $TiO_2$ 0.3%, $Fe_2O_3$ 0.3%, and $SiO_2$ 32%.

The corroidal silica contains $SiO_2$ 30%, viscosity 6-23 sec (by No. 5 ZAHN CUP).

The dimensions and mechanical properties of the ceramic mold were as follows:

(a) Thickness: 5.5 mm approximately (b) Wet strength: 660 PSI (c) Dry strength: 800 PSI (d) Air permeability: $1.2\times10^{-3}$ $cm^3/sec.cm^2.aq$.

In order to determine the relationship between the strength of a ceramic mold and heat, the inventor made several tests. As a result of the tests, it was discovered that the yield was improved by breaking a ceramic mold immediately after the formation of the alloy casting rather than by removing a ceramic mold after the casting had been cooled to room temperature. However, one must be very careful in breaking a ceramic mold immediately after the formation of the alloy casting so as not to be burnt by the heat or to damage the casting.

Through the aforesaid tests, it was evident that changing the structure of a ceramic mold could effectively eliminate the cracking problem. However, the dry strength of a ceramic mold should be controlled a lower level than the shrinkage stress of the alloy casting so that the alloy casting will not be caused to crack by the stress. Therefore, the strength of a ceramic mold to be used should be reduced as low as possible without affecting its ability to bear the heat impact of the molten alloy. According to statistical findings, the rate of cracking increases when the dry strength of a ceramic mold exceeds 550 psi.

According to several tests, a ceramic mold having the following compositions is preferable.

1st layer: zircon sand 325 mesh 60-70%, corroidal silica 30-20% and zircon sands 100 mesh 10%;

2nd layer: MULCOA powder 200 mesh 55-65%, scaly graphite 3-6%, corroidal silica 20-25%, and MULCOA powder 0.25-0.5 m/m 22-4%;

3rd layer: MULCOA powder 200 mesh 55-65%, graphite 3-6%, corroidal silica 35-20%, MULCOA powder 0.25-0.5 m/m 7-9%;

4th layer: MULCOA powder 200 mesh 55-65%, graphite 8-4%, corroidal silica 30-20%, and MULCOA powder 0.50-1.0 m/m 7-11%; and 5th layer: MULCOA powder 200 mesh 60-70%, scaly graphite 4-8%, and corroidal silica 36-22%.

The content of the MULCOA powder and the corridal silica is the same as above.

The dimensions and mechanical properties of the ceramic mold are as follows:

(a) Thickness: 5.0 mm approximately
(b) Wet strength: 350 PSI
(c) Dry strength: 460 PSI
(d) Air permeability: $6.5\times10^{-3}$ $cm^3/sec.cm^2.aq.$ The ceramic molds according to the aforesaid specifications give a good yield of alloy casting product of more than 80% and the defective rate can be reduced to below 20%. According to a test, defective products are caused by misrun (the process of pouring is not finished within 9 sec.), inclusion (poor immersion), and heat-cracking (hot spot problem).

To summarize the casting process described above, the process of casting according to the present invention includes (1) preparing a ceramic casting mold in accordance with the foregoing specifications, and heating it to a temperature of 1300° C.±10° C.; and (2) warming the alloy ingots during the heating of the ceramic mold, and heating the alloy ingots until they melt within 20–25 minutes. As soon as the ceramic mold has been heated to 1200° C., the molten alloy is cast at a temperature of 1400°–1420° C.

2. WELDING

Figure 7:
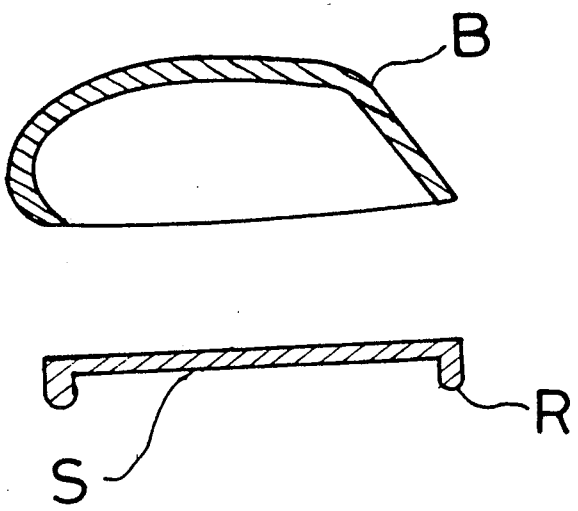
FIG. 7 is a schematic cross-sectional view of a head body and a sole of the metal wood, to be welded together.

A "metal wood" is composed of two parts as shown in FIG. 7, namely, a body B and a bottom plate S (sole) respectively made of the above described alloy castings, and the two parts are joined together by welding.

Because Fe-Mn-Al alloys provide low heat conductivity, a cooling stress tends to occur after the casting has been subjected to high welding temperatures, and such cooling stress causes a cracking problem. This problem becomes more evident during the production of an alloy casting having a thin and uneven body. During a continuous welding process at a high temperature, a carbide compound may continuously be produced at the boundary of its metallic crystals causing its ductility and strength to be unfavorably affected. Further, it is difficult to obtain an appropriate welding rod from the market for welding an Fe-Mn-Al alloy casting. In several welding tests using JIS D304, 308, 316 nickel-chrome steel and high manganese steel welding rods, cracks were detected around the welding area, and the welding quality was not satisfactory. The presence of a carbide compound was detected through a metallographic microscope. An electron microscope (S.E.M.) found $Al_2O_3$ in the cracked area. This poor welding quality occurred because the melting point of Al-Mn-Fe alloys is lower than the welding rod of nickel-chrome steel and high manganese steel. During the process of welding an Fe-Mn-Al alloy casting, the casting is locally subjected to high welding temperatures which incur a stress after the welding, and also cause the formation of a carbide compound at its crystal boundary, so the alloy casting therefore becomes fragile. In other tests, by using aluminum welding rod of low melting point, pure aluminum welding rendered the worst results. In comparison, the 6000 series welding rod containing silicon rendered a better result but welding track was evident and cinder holes were found, and further, a part of the welded area was molten during heat treatment at 1050° C. In other welding tests, by pre-heating the alloy castings to be welded to 150° C., 300° C., 500° C. separately for comparison (using a welding rod of JIS D308, of 8 mm diameter), it was found that preheating the alloy casting to 500° C. provided a welding quality better than others; however, fine cracks or cinder holes were still discovered. Therefore, this method is still not satisfactory. Further, it is not easy to pre-heat an alloy casting to a pre-determined temperature. In order to obtain a satisfactory welding quality, the inventor has tried to prepare a welding rod by himself. An Fe-Mn-Al rod, 8 mm in diameter, was heat-treated at 1050° C. for one hour and then hot-rolled to reduce its diameter to 2.0 mm. The attempt was not successful as the roller of the rolling press could not withstand the toughness of the alloy and tended to wear out quickly before the welding rod was completed. Further, the welding rod thus obtained tended to have an oxidized outer surface. Therefore, the inventor tried another welding process without using any welding rod. Under the best welding conditions (Tungsten Inert Gas (TIG) welding, welding current 40–60 ampere) and by means of a welding robot, a welding process was performed on an Fe-Mn-al alloy metal wood casting. Before the welding of the alloy casting, a ridge R of 2 mm high and 2 mm wide was made along the side edge of the bottom plate as shown in FIG. 7. At the beginning, good welding quality was obtained, however the welding track started to dent at the mid-way, and a crack or rupture was found at the end. It is believed that this problem happens because of the cooling stress and overheated welding. Therefore, an intermittent welding process was tried with the goal of eliminating the formation of cumulative stress. This intermittent welding process has been proven satisfactory. In performing such an intermittent welding process, the movement of the welding head must be properly controlled because oxidized aluminum slag may obstruct the performance of the welding and thus cause incomplete welding. If such a welding operation is to be performed manually, a welding rod of Austenite steel may be use as an electrode. According to this procedure, more than sixty percent of yield can be achieved and the defective workpieces which may have cinder holes or fine cracks can be repaired without great difficulty.

3. HEAT TREATMENT

Figure 4:
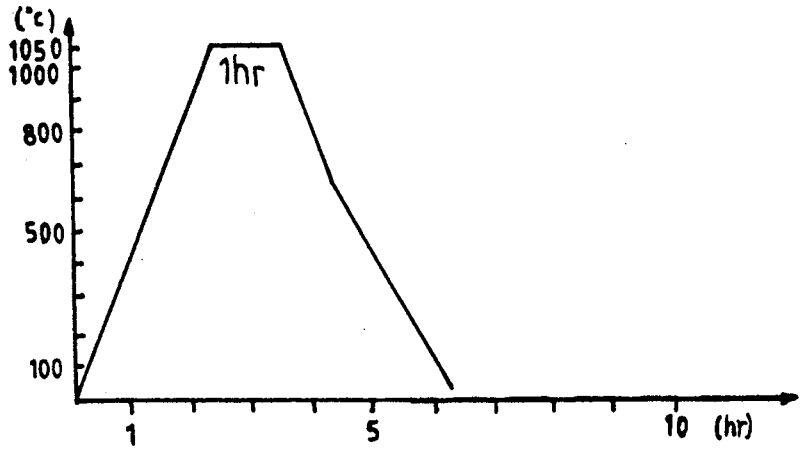
FIG. 4 is a diagram showing the relation between the temperature and time for heat-treating the alloy casting by a nitrogen cooling procedure in a vacuum furnace operation, to obtain a hardness of HRC 32-36.
Figure 5:
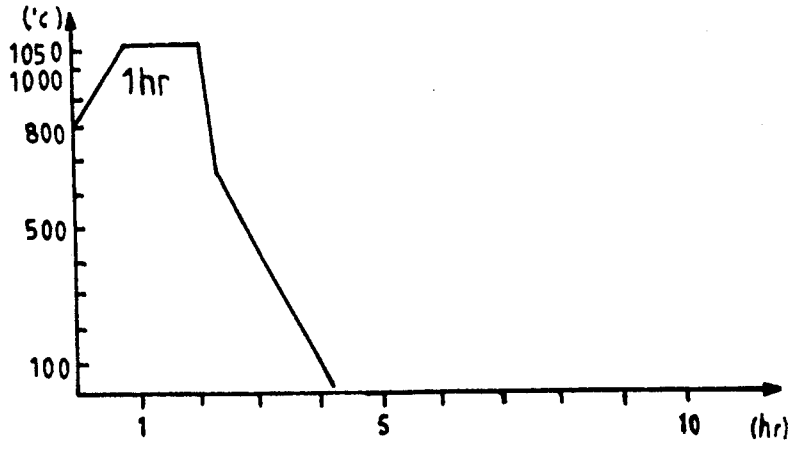
FIG. 5 is a diagram showing the relation between the temperature and time for heat-treating the alloy casting by a nitrogen cooling procedure in a continuous furnace operation, to obtain a hardness of HRC 28-32.
Figure 6:
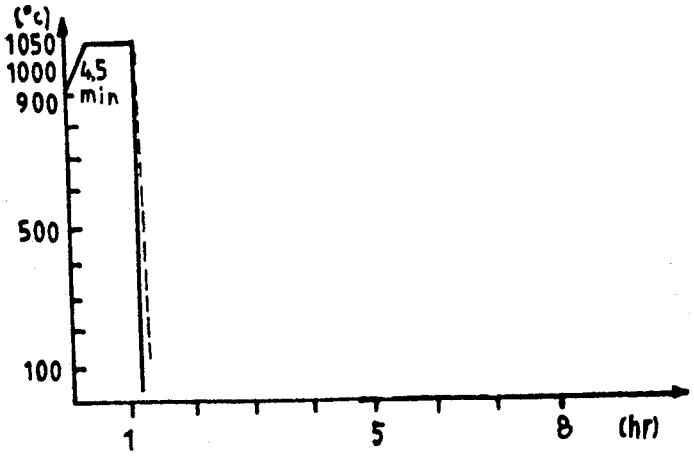
FIG. 6 is a diagram showing the relation between the temperature and time for heat-treating the alloy casting in a high temperature furnace and then quenching the casting to obtain a hardness of HRC 8-10 or 10-26.

A metal wood alloy casting must be tempered and age hardened before it is finally finished. A vacuum furnace, a continuous furnace and a high temperature furnace are commonly used for the heat treatment. A nitrogen cooling procedure is applied when a vacuum or continuous furnace is used. Water quenching or oil quenching may be applied in association with a high temperature furnace. These heat treatments may produce different results in the properties of an Fe-Mn-Al alloy casting. As shown in FIG. 4, if the alloy casting is heat-treated by a vacuum furnace, less oxidized coating is formed on its surface, its hardness becomes excessively high, its toughness becomes very low, its structural strength becomes weak, and, further, its compressive strength drops to as low as 1500–1700 $kg/mm^2$ (tested with an universal material testing machine). As shown in FIG. 5, if an alloy casting is treated by a continuous furnace, less oxidized coating is formed and a proper hardness can be obtained, however the compressive strength will be about 1700–2000 $kg/mm^2$ which is still not satisfactory. As shown in FIG. 6, an alloy casting which is treated by a high temperature furnace then followed by the process of water quenching or oil quenching shows a fine structure and good toughness, however, its hardness is not satisfactory and, it has a thick oxidized surface. If the length of time and the temperature are not properly controlled during the heat treatment, the oxidized surface layer will become thick and the surface of the casting will become uneven. If a continuous furnace is used, a rapid cooling effect can be achieved by reducing the number of the alloy castings to be treated per lot and increasing the flow rate of nitrogen. According to this modified method, a maximum compressive strength of 2700 kg/mm$^2$ and an average compressive strength of 2100 kg/mm$^2$ can be achieved. However, this modified method is still not suitable for mass production because a stable and uniform cooling effect can not be achieved when the flow rate of nitrogen is increased. If the alloy castings of the same lot are not uniformly cooled, they may have different hardnesses after the heat treatment. Therefore, water quenching and oil quenching have been considered again. When water quenching or oil quenching is used, heating time must be shortened so as to prevent the formation of a thick oxidized coating. Therefore, before putting the alloy castings in a high temperature furnace, the high temperature furnace must be preheated to 900° C. After the alloy castings have been heated in the high temperature furnace to 1030°-1050° C. and maintained for 1-2 hours, the alloy castings are taken out for water quenching or oil quenching. After the quenching, the alloy castings are machine-finished. Because at this stage, the alloy castings have a relatively lower hardness, the machining process is easy to perform. After the machining, the alloy castings are hardened at 450° C.-550° C. for 1-2 hours to increase their hardness from HRC8 to HRC28-36. This procedure can effectively increase the hardness of the alloy casting without affecting its compressive strength. However, if the hardening temperature is increased to 550° C., the alloy casting will become fragile and its compressive strength will be greatly reduced.

After the hardening, the alloy casting can be further finished through the process of sand blasting so as to remove its oxidized surface layer for final polishing. The alloy casting which has been oil quenched may have the oily substance adhere to or penetrate through its surface and thus cause a sand wheel to slip during polishing; therefore, further coating operations may be badly affected if the oily substance is first removed.

Although a layer of $Al_2O_3$ will be formed on a Fe-Mn-Al alloy casting by itself and such layer may resist the corrosive atmosphere, it may not withstand attack from chemical solutions. Therefore, a protective coating is required to improve the capability of an Fe-Mn-Al alloy casting against corrosion. However, regular coating materials for metals such as enamels are not suitable for coating an Fe-Mn-Al alloy casting. A test of spraying a 5% saline revealed that rust was produced on an Fe-Mn-Al alloy casting, and the protective coating thereof was stripped off. This problem has been eliminated by covering the alloy casting with a layer of primer (of thickness 3-5 u) through the process of immersion before baking. The alloy casting treated through this coating method has proven equal to a PH17-4 product in corrosion protection under the test of 5% saline for 24 hours.

Attached hereinafter is a comparison chart showing the properties of metal woods made from different methods.

| | THE INVENTION | JIS 431 | JIS 630 |
|---|---|---|---|
| Tensile strength (kg/mm$^2$) | 87.5 | 76 | 80 |
| Yield strength (kg/mm$^2$) | 67 | 60 | 65 |
| Extensibility (%) | 24 | 15 | 16 |
| Specific gravity (g/cm$^2$) | 6.8 | 7.75 | 7.80 |
| Hardness (HRC) | 28-36 | 30-34 | 34-35 |
| Impact strength (kg/cm$^2$) | 2400 up | 2000 up | 2200 up |
| Size ratio (V/W) | 1 (205 cm$^2$/200 g) | 0.8 (165 cm$^2$/200 g) | 0.8 (165 cm$^2$/200 g) |
| Shock absorption | good | bad | bad |
| Striking sound | low | high | high |

It is evident from the above chart that the metal wood made by the method of this invention has advantageous properties over the ones made according to known methods.

What is claimed is:

1. A method for manufacturing an Fe-Mn-Al alloy casting made from an alloy which comprises carbon 1.5-2.0%, manganese 22-36%, aluminum 6-8%, molybdenum 1.0-1.5% and iron remainder, the method comprising the steps of casting the molten alloy to obtain alloy castings, welding the alloy castings to obtain a shaped casting, and heat treating the welded, shaped casting;

said casting step comprises melting said alloy to 1400°-1420° C. and pouring the molten alloy thus obtained into a ceramic mold which has been heated to 1300°-1320° C., said ceramic mold being comprised of five layers and having a wall thickness about 5.0 mm, a wet strength about 350 psi, a dry strength about 460 psi, and air permeability about $6.5\times10^{-3}$ cm$^3$/sec. cm.$^2$aq., said welding step being performed by a TIG welding with welding current 40-60 amperes; and said heat treatment processing step including heating the welded, shaped casting to 1030°-1050° C. for 1-2 hours and then quenching the welded shaped casting in water or oil at room temperature, and then heating the welded, shaped casting at 450°-550° C. for 1-2 hours.

2. The method of claim 1, wherein said Fe-Mn-Al alloy casting is a golf club head.

* * * * *